US008360083B2

(12) United States Patent
Anders, III

(10) Patent No.: US 8,360,083 B2
(45) Date of Patent: Jan. 29, 2013

(54) HUNTING BLIND

(76) Inventor: Otto A. Anders, III, Piedmont, SC (US)

( * ) Notice: Subject to any disclaimer, the term of this patent is extended or adjusted under 35 U.S.C. 154(b) by 56 days.

(21) Appl. No.: 12/925,034

(22) Filed: Oct. 12, 2010

(65) Prior Publication Data

US 2012/0085381 A1 Apr. 12, 2012

(51) Int. Cl.
*E04H 15/04* (2006.01)

(52) U.S. Cl. ..... 135/90; 135/99; 135/151; 135/152; 43/1

(58) Field of Classification Search ..... 135/117, 135/152, 90, 99, 151; 43/1–3
See application file for complete search history.

(56) References Cited

U.S. PATENT DOCUMENTS 578,649 A * 3/1897 Mass ..... 135/88.04
714,650 A * 11/1902 Truscott et al. ..... 135/155
1,493,915 A * 5/1924 Baker ..... 135/146
1,526,726 A * 2/1925 Townsend ..... 135/99
2,644,592 A * 7/1953 Campion ..... 211/197
3,358,789 A 12/1967 Laun
3,485,320 A 12/1969 Jones
3,690,334 A 9/1972 Miller
3,902,264 A * 9/1975 Radig ..... 43/1
3,913,598 A * 10/1975 Glutting et al. ..... 135/152
4,433,699 A * 2/1984 Schultes et al. ..... 135/15.1
4,505,286 A 3/1985 Madion
4,632,138 A * 12/1986 Irwin ..... 135/143
4,739,785 A * 4/1988 Poulson ..... 135/117
4,825,578 A * 5/1989 Robinson ..... 43/1
5,218,982 A 6/1993 Kenji
D337,366 S 7/1993 Baker
5,259,408 A * 11/1993 Guerin ..... 135/90
5,579,797 A * 12/1996 Rogers ..... 135/90
5,613,512 A 3/1997 Bean
5,669,403 A 9/1997 Belcher et al.
6,422,252 B1 * 7/2002 Pilz et al. ..... 135/98
7,182,091 B2 2/2007 Maddox
7,246,630 B1 7/2007 Ransom et al.
7,594,515 B2 * 9/2009 Prock ..... 135/117
2002/0078988 A1 6/2002 Valpredo
2007/0017744 A1 1/2007 Jacks
2007/0251561 A1 11/2007 Lee
2008/0135080 A1 6/2008 Greene

* cited by examiner

*Primary Examiner* — Noah Chandler Hawk
(74) *Attorney, Agent, or Firm* — Cort Flint; Monahan & Moses, LLC

(57) ABSTRACT

A portable hunting blind which is easily set up to provide the hunter with a sit or stand to search position, and a stand to shoot position. The blind includes a frame which is foldable into a collapsed position and expandable into a support position. A shaped cover is supported by the frame to provide a plurality of front panels, a pair of side panels, and a rear panel. The front panels include horizontal slits for searching and vertical slits for shooting.

11 Claims, 6 Drawing Sheets

Fig. 1
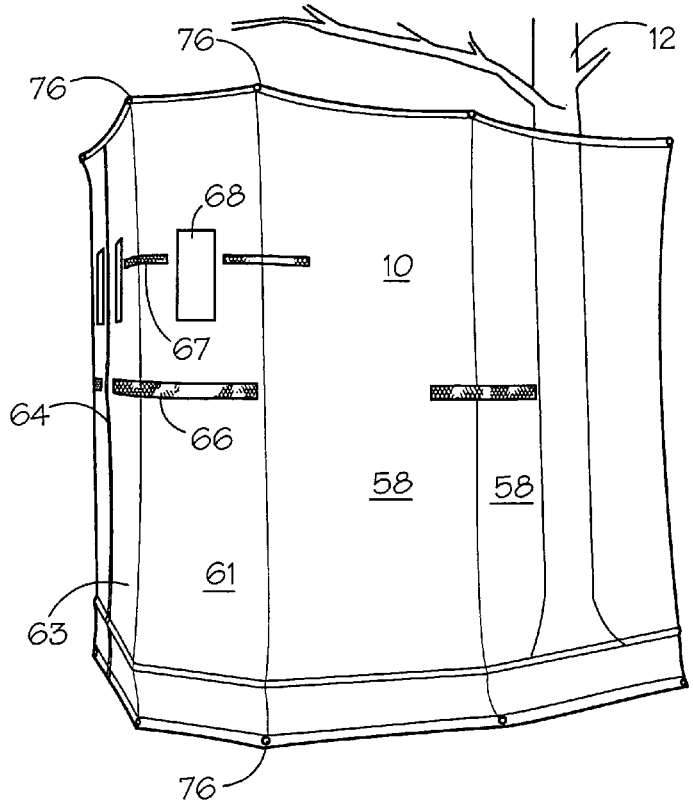
Fig. 2
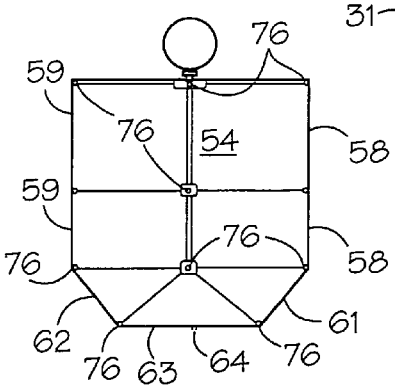
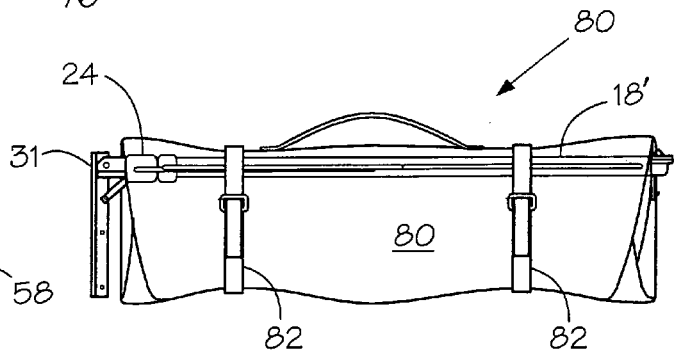
Fig. 3

HUNTING BLIND

BACKGROUND OF THE INVENTION

Hunting blinds have long been used by hunters and are therefore well known in the sport of hunting. The conventional hunting blind fails to provide solutions for several common deficiencies. Primarily, hunting blinds are not easily transportable, nor easily erected or taken down. Present hunting blinds do not provide multiple sighting or searching locations in which the hunter may assume either a sitting or a standing position and separate shooting locations.

Accordingly, an object of the present invention is the provision of a lightweight, portable, and easily set up hunting blind.

Another object of the present invention is the provision of multi-level sighting and shooting slits in a hunting blind.

Still another object of the present invention is the provision of a frame for a hunting blind operable to be positioned in an expanded support position and a retracted carrying position.

Another object of the invention is the provision of a frame which connects with the cover in fixed position allowing the frame and cover to be moved between an extended position, in which the frame and cover are in the hunting position, and a retracted position, in which the frame and cover are in position to be transported.

SUMMARY OF THE INVENTION

The instant invention is directed to a hunting blind adaptable between a portable position and a hunting position. The blind comprises a support frame which includes a support rod mounting a plurality of pivotal fingers at a first end, a pair of intermediate pivotal fingers at an intermediate position, and a pair of pivotal fingers at a second end. The support rod and each of the fingers is moveable between an extended position and a transport position.

A mounting member is connected with the second end of the support rod. The mounting member is operative to secure with an upstanding vertical member to retain the support frame in a desired elevated position.

A flexible cover is shaped to include a top panel, a plurality of side panels, and a back panel. The back panels are all connected along one edge with the top panel, and along opposed edges with an adjacent of said side, front, and back panels to form an enclosure.

A plurality of horizontal sighting slits are formed at a first elevation in selected of the panels. These slits function to provide sight access through the panels.

A plurality of larger vertical slits are formed in selected of the panels at a second elevation above the horizontal slits. These second slits provide shooting openings through which projectiles may be shot.

The blind may be transported in the portable position to a desirable location and arranged into the hunting position providing an enclosure for concealing a hunter.

The cover includes grommets located in specific positions over the cover. One of the grommets is located at each intersection of the top edge and the opposed edge of the panels.

The ends of the pivotal fingers are secured to the cover with securing elements passing through selected of the grommets and connecting with the associated end of the fingers. The cover is retained in fixed position relative to the support frame by way of these securing elements.

The mounting member comprises an elongated mounting bracket having a generally concave interface with an outer face having elongated guide slots along its length. The guide slots act to receive an elongated slide capable of longitudinal movement. The mounting member includes a plurality of transverse slots along its length and between the guide slots. A latch is provided for engaging with the transverse slots to lock the mounting member in selected vertical positions along the mounting bracket.

The mounting rod includes an inner and outer member. The inner member is telescopically carried within the outer member and is moveable between an extended position and a transport position. A locking arrangement secures the inner member in fixed position when in the transport position and the extended position.

The mounting rod carries a mounting clasp at the first end, the intermediate position, and the second end. The mounting clasp engages with ends of the fingers for pivotal movement between said extended and transport positions.

There are four of the fingers mounted at the first end for supporting the panels of the blind front to include a first face extending generally perpendicular of the support rod axis, and a pair of second faces extending generally diagonally of the support rod axis. These faces provide a panoramic searching and shooting side through the vertical and horizontal slits.

Selected of the sighting slits are located at a horizontal position generally level with a hunter's eyes when sitting. Second sighting slits are arranged at a higher horizontal position generally level with the hunter's eyes when standing. In this manner the blind provides for a sitting position or a standing position while searching for game and a standing position for shooting game.

DESCRIPTION OF THE DRAWINGS

The construction designed to carry out the invention will hereinafter be described, together with other features thereof.

The invention will be more readily understood from a reading of the specification and by reference to the accompanying drawings forming a part thereof, wherein an example of the invention is shown and wherein:

FIG. 1 is a perspective view of the hunting blind of the invention in the hunting position.

FIG. 2 is a top view of the blind shown in FIG. 1.

FIG. 3 is a side view of the hunting blind of the invention in the carrying position

DESCRIPTION OF A PREFERRED EMBODIMENT

Figure 4:
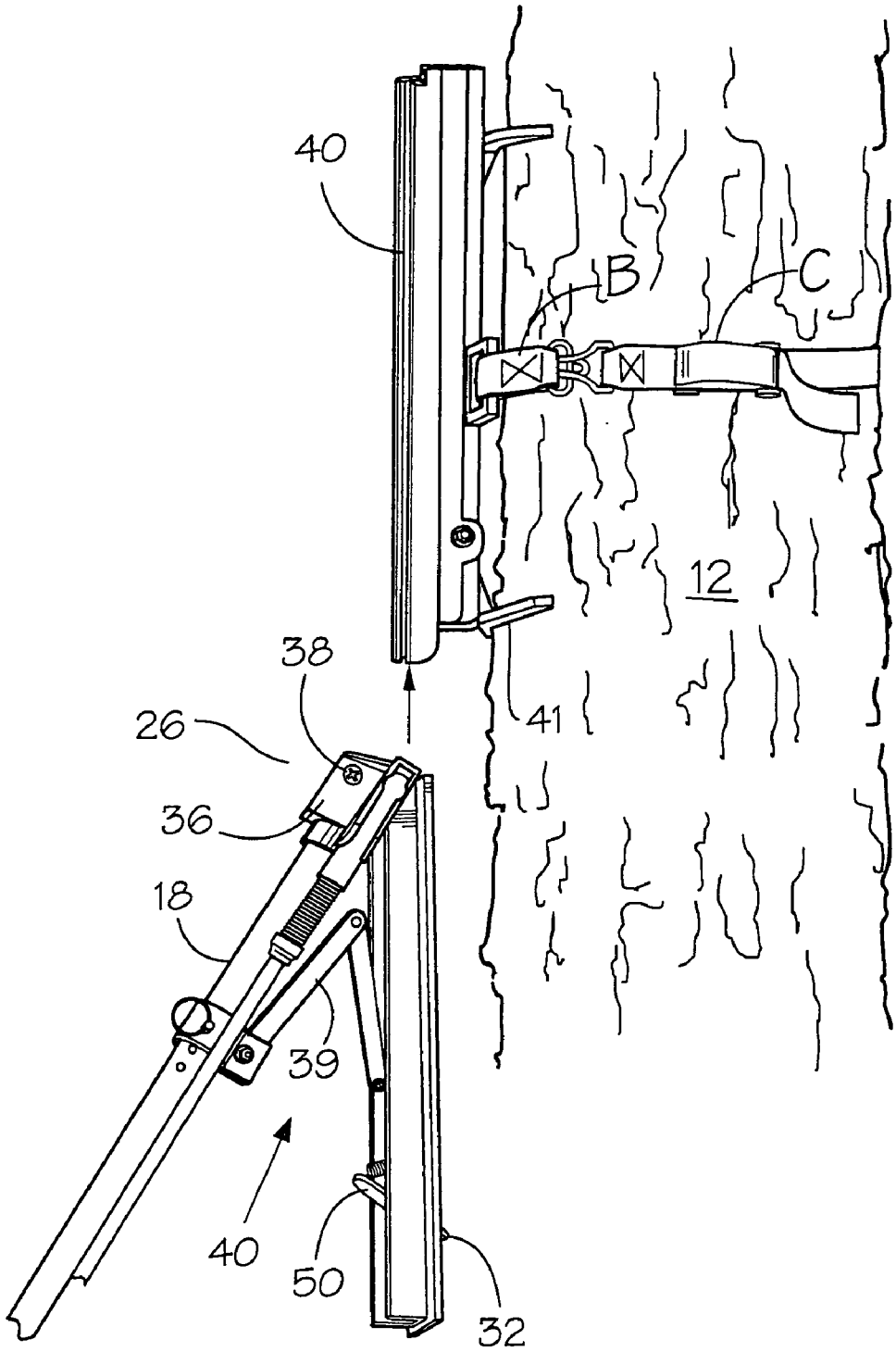
FIG. 4 is an exploded side view of the mounting member for the hunting blind of the invention.

Referring now to the drawings, the invention will now be described in more detail.

Turning to FIGS. 1, 2, 11, and 12, the hunting blind of the invention is shown in its erect or hunting position A connected to tree 12. In this position cover 10 is held in a desired or adjustable elevated position adjacent tree 12 by frame 14. In this position cover top 54 is held to extend substantially parallel with the ground while each of the side panels extend in a position generally perpendicular of top 54 and parallel each other.

Figure 8:
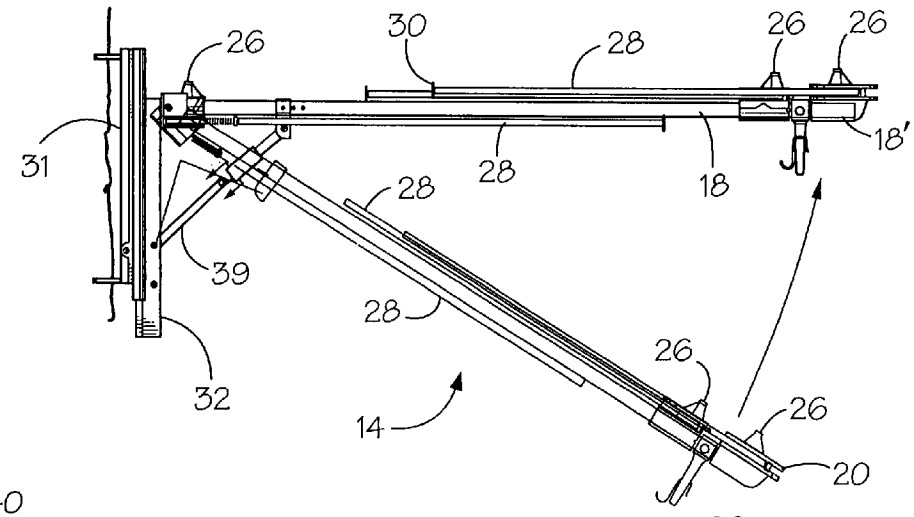
FIG. 8 is a side view of the mounting frame with the support rod in retracted position.
Figure 9:
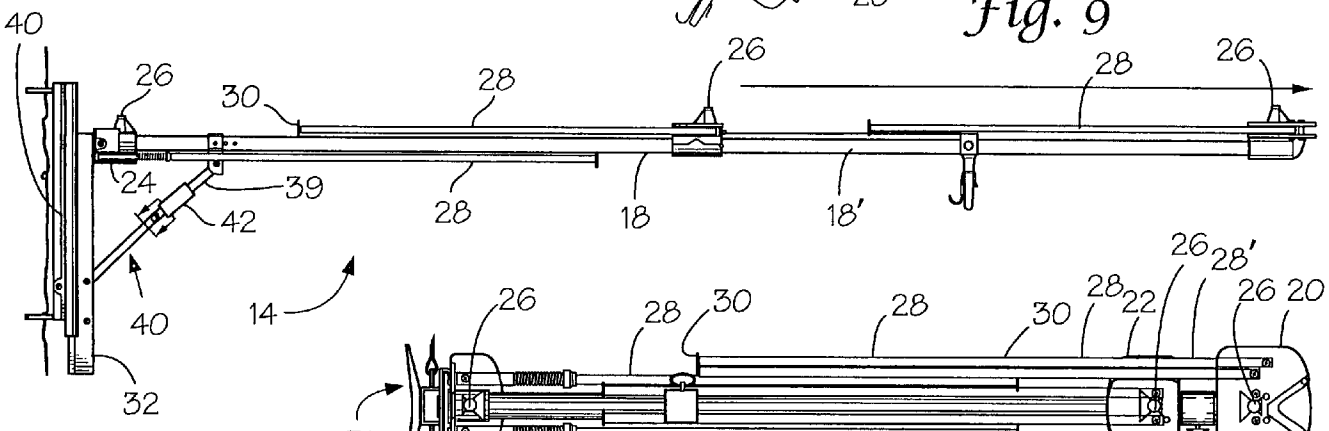
FIG. 9 is a side view of the mounting frame with the support rod in extended position.

Turning now to FIGS. 5-11, the frame or support frame 14 will be described in more detail. Frame 14 is constructed of preferably lightweight metal and includes a pair of lightweight rods, or support rods 18, 18', which are telescopely connected in the area of hinge 22. This connection allows rod 18' to be drawn into its extended position, as shown in FIG. 9, or moved inside rod 18 into its retracted position. A conventional locking member may be used to lock the rods in either position.

There are three hinges 20, 22, and 24 carried by frame 14 in fixed position relative to rods 18, 18'. Each hinge includes a protrusion 26 which extends upward from its upper surface, as best seen in FIG. 9. Each protrusion is formed to receive and secure with a bolt.

Outer hinge 20 is constructed to mount for pivotal movement four fingers 28, 28' at one end. Fingers 28, 28' are preferably formed of lightweight metal tubing with each having a threaded receptacle 30 at its outer end.

Fingers 28 are mounted for pivotal movement by hinge 20 between an extended position in which they extend perpendicularly of the axis of support rod 18, 18' and a retracted position in which they extend generally parallel with that axis.

Fingers 28' are also mounted for pivotal movement by hinge 20 between extended positions generally 45° of the axis of support rods 18, 18' and retracted positions generally parallel that axis. See FIGS. 10 and 11. Hinge 20 may be of any known construction which employs spring or resilient force to lock the fingers in each of the extended and retracted positions.

Figure 10:
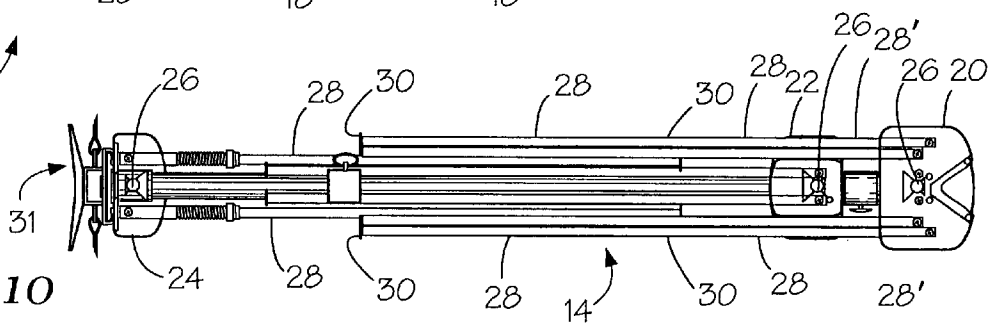
FIG. 10 is a top view of the mounting frame with the support rod and fingers in retracted position.
Figure 11:
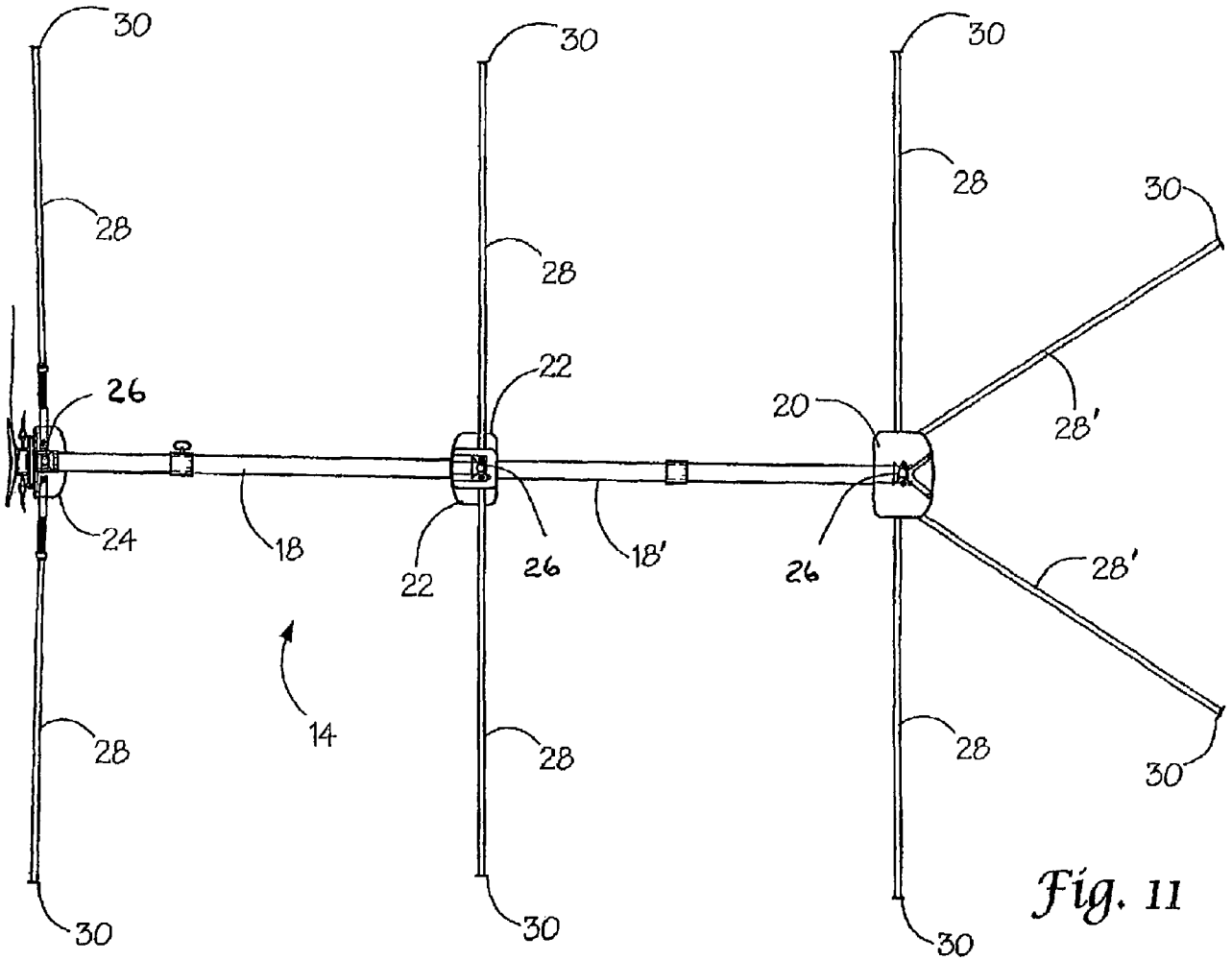
FIG. 11 is a top view of the support frame with the support rod and fingers in the extended position.

Hinge 22 pivotally mounts a pair of fingers 28 to move between extended positions, as shown in FIG. 11, and retracted positions, as shown in FIG. 10.

Hinge 24 is secured with the inner end of support rod 18 and also carries a pair of fingers 28 which move between extended positions generally perpendicular the axis rod 18, 18', as shown in FIG. 11, and retracted positions, as shown in FIG. 10. Inner end hinge 24 also uses resilient pressure to position the fingers in fixed extended positions and retracted positions.

The inner end of support rod 18 pivotally mounts slide 32. Slide 32 comprises a generally flat rectangular member having a spaced pair of upright arms 34 extending along its length. A pivot comprising a pair of ears formed on arms 34 and housing 36 carried on end rod 18 are pivotally engaged through pin 38, as shown in FIGS. 4 and 5, allowing support rods 18, 18' to pivot relative to slide 32.

Figure 5:
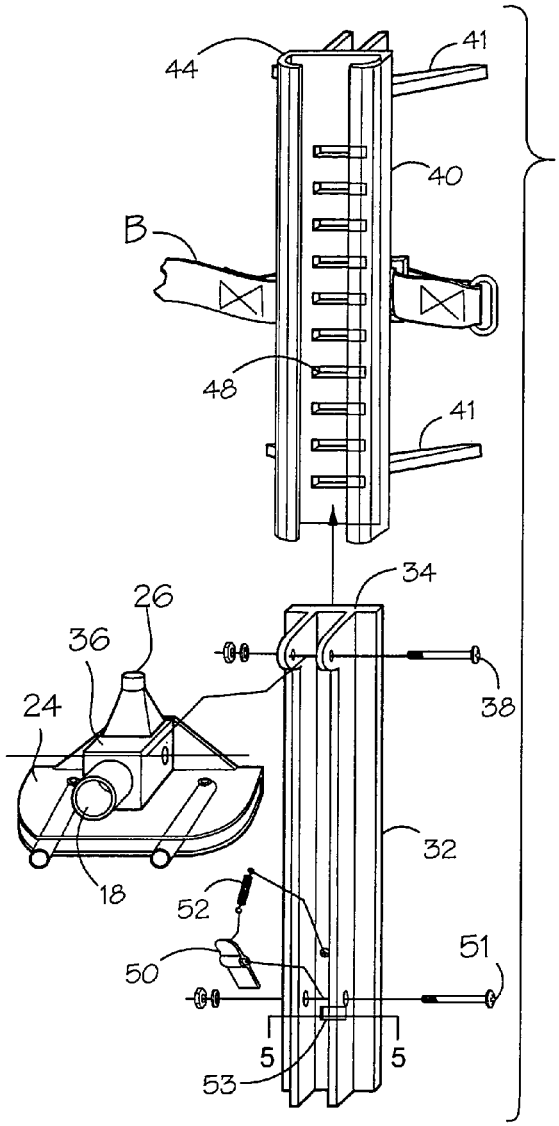
FIG. 5 is an exploded view of the components of the mounting member of FIG. 4.

A hinge mechanism 40 comprising a pair of pivotally engaged levers 39, a first of which is pivotally engaged with support rod 18 and a second of which is engaged with slide 30, is operative to allow rod 18 to be pivotally positioned in selected positions relative to slide 32, as generally indicated in FIGS. 4, 8 and 9, for assisting in engaging slide 32 with mounting bracket 40. When mounted with mounting bracket 40 levers 39 are pivoted to extend end-to-end along a common axis, as shown in FIGS. 8 and 9, and are locked in that position by sleeve 42. With mounting bracket 40 in this position, support rods 18, 18' are held in a position perpendicular the longitudinal axis of mounting bracket and mounting slide 32, 40.

Figure 6:
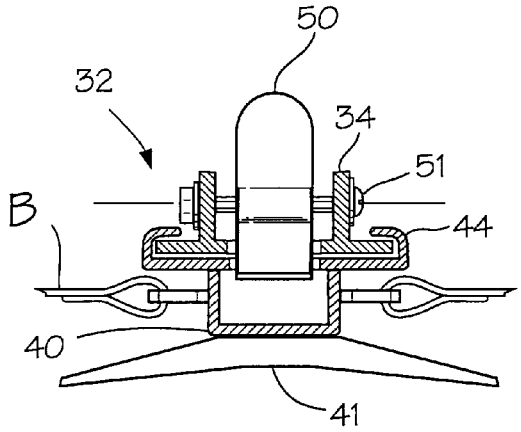
FIG. 6 is a cutaway view of FIG. 5 taken along line 5-5 showing the latch member.
Figure 7:
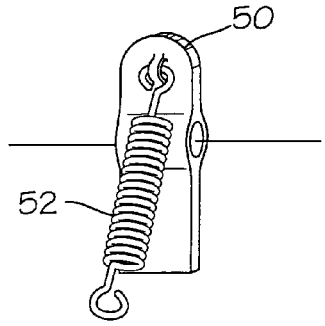
FIG. 7 is an exploded-perspective view of the latch of the mounting member.

Mounting bracket 40 comprises a shaped elongated member having a back side including a pair of generally concave surfaces 41 which engage with the generally rounded outer surface of a tree. The outer side of bracket 40 is generally planar with a pair of inwardly directed ears 44 forming a guide path for slide 32, as shown in FIG. 6.

A belt B is connected centrally of mounting bracket 40, as shown in FIG. 4. Belt B is provided with a come-along C of known and usual structure. In practice mounting bracket 40 is positioned in a selected position along the trunk of tree 12. The ends of belt B are engaged and come-along C is actuated to draw the belt tight about the tree. Mounting bracket 40 is securely held in position with the tree, as seen in FIG. 4.

Bracket 40 is provided with a plurality of vertically spaced slots 48, as seen in FIG. 5. Slide 32 has a latch 50 pivotally mounted between arms 34 by pin 51. Spring 52 continuously urges the end of latch 50 through opening 53 formed between arms 34 in a position which extends below the lower surface of slide 32. See FIGS. 4, 5, 6 and 7.

In practice, with bracket 40 in position with a tree, slide 32 is positioned with its edges beneath ears 44 and urged upwardly until slide 32 is at the desired vertical height. As the slide moves through bracket 40 the end of latch 50 pivots into successive slots 48 formed in the bracket. As upward movement pivots latch 50 in a counter-clockwise direction, the latch is allowed upward movement through slot 53 of the slide. When the desired position is obtained, slide 32 is released where its weight urges it downwardly. Movement in this direction urges latch 50 in a clockwise direction which is prevented or stopped by the edge of slot 53 causing latch 50, and a selected slot 48 of bracket 40, to hold slide 32 in the selected position. To remove the slide from bracket 40, latch 50 is simply pivoted by hand above slots 48 allowing the slides to slip from the bracket.

Cover 10 is made of lightweight material, generally nylon fabric, and is shaped to comprise in the hunting position a shaped top 54 and a plurality of outer panels which extend generally downward and vertically from the outer edges of top 50. The outer panels comprise back panel 56, two right and left side panels 58, 59. The side panels extend generally perpendicularly of back panel 56, and generally parallel of the axis of support rod 18, 18'. There are three front panels 61, 62 and 63. Panels 61 and 62 extend out generally at a 45° angle to the longitudinal axis of support rod 18, 18', while front panel 63 extends generally perpendicular of the axis of the support rods. Front panels 60, 61, and 62 provide a generally panoramic view.

Front panel 63 is formed in two equally sized sections interconnected by zipper 64 which extends along their length. See FIGS. 1 and 12. The zipper provides an opening of entry and exit of the hunting blind.

There are a plurality of horizontal slits or openings 66, 67 formed in panels 58, 59, 60, 61, and 62. These slits are about 12" long and about 2" high, covered with a mesh fabric which can easily be seen through but conceals the person inside. Slits 66 are formed about midway of the panel in a position generally aligned with a person's eye level when sitting in the blind. Slits 67 are spaced upward of slits 66 to be in a position generally aligned with a person's eye level when standing in the blind. Slits 66 and 67 are searching or sighting slits used by the hunter when waiting for game to approach the blind. Slits 68 are vertically arranged to be about 6" wide and 12" high. These slits are open and are arranged to be about head level of a person standing in the blind. Slits 68 are shooting slits, the openings through which the hunter shoots the game which has been located through the sighting and searching slits.

The lower portions of the panels, about 12" from the lower edge of the blind, are provided with horizontal tubular sleeves 70 which carry individual rods 72. Rods 72, which are about equal in length of the panel width, are connected by rubber tubes which frictionally engage with adjacent ends of rods 72 forming a configuration which corresponds with the outer periphery of top 54.

Figure 12:
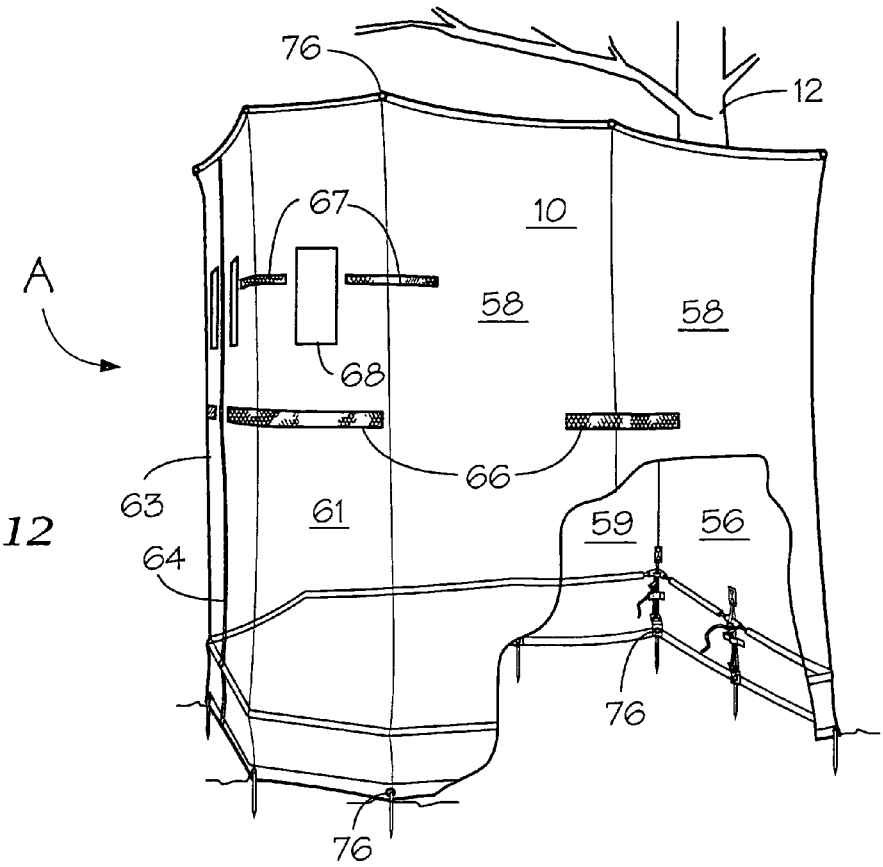
FIG. 12 is a cutaway perspective view of the blind of the invention showing in cutaway the bottom frame, and mounting sleeves.
Figure 13:
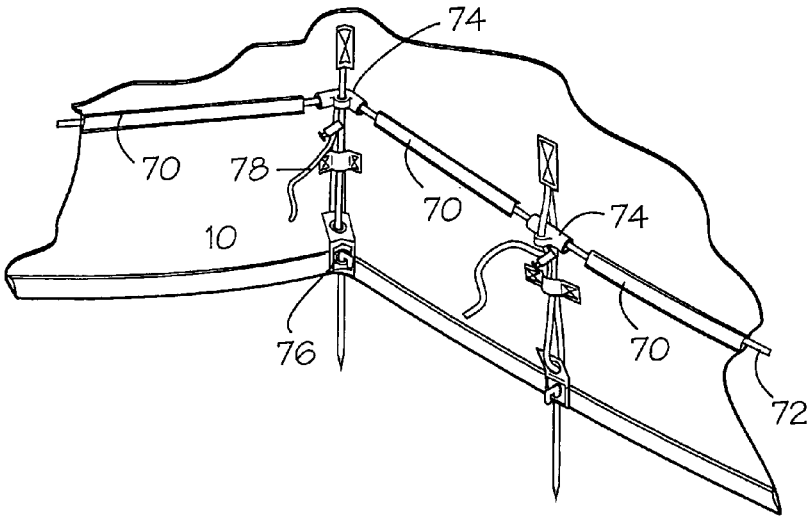
FIG. 13 is an exploded sectional view of the bottom frame carried by sleeves attached to the side panels.

Cover 10 is provided with grommets 76 along upper and lower edges where panels 56-61 engage each other, and along the center of top 64 in position to coincide with the position of protrusions 26 when frame 14 is in its extended position. Fastening members, preferably bolts, are passed through the grommets and engaged with the receptors 30 located on the outer ends of fingers 28 and protrusions 26 located on the upper side of hinge members 20, 22 and 24. With frame 14 in its extended or support position, cover 10 is shaped as shown in FIGS. 1 and 12. Rods 72 engaged by tubes 74 shape the lower portion of cover 10 to correspond with the shape of the upper end or top and also provides weight to hold the lower edges down. Tie downs 78, which are well known, may be engaged with the rods and/or grommets 76 along the lower edge of the panels to further hold the blind in fixed position. The area below tubes 70 provides for vertical adjustment of the cover.

Zipper 64 interconnecting front panels 63 along their length, provide entry and exit of the blind. Zipper 64 allows the panels to simply be disconnected at the lower ends forming a handicap accessible opening into the blind.

A carrier 80 comprising a shaped sheet of fabric having a pair of spaced belts 82 attached thereto is provided. See FIG. 3.

When it is desired to position the blind in the transport position fingers 28, 28' are simply pivoted to the transport position in which they extend parallel the axis of support rod 18, 18'. Tubes 74 are disengaged allowing cover 10 to fold alongside fingers 28, 28'. Support rod 18' is telescoped into rod 18. Slide 32 is removed from bracket 40. The lower portion of the blind is gathered along and below support rods 18, 18'. The carrier is spread in a flat position. The blind is placed on the fabric of carrier 80, and belts 82 are placed about the blind and carrier and are engaged. The blind is now in its transport position where it may be easily carried by a single person to a desired point. If desired, a handle is secured with the fabric as seen in FIG. 3.

To set up the blind mounting bracket 40 is separated from slide 32 and secured in a desired position with a tree. Belts 82 are released and the blind is unrolled or unfolded. Support rod 18, 18' is moved to the extended position and fingers 28, 28' are moved to their extended position. Slide 32 is engaged with bracket 40 at a desired height. Cover 10 being fixedly engaged with frame 14 is moved into its intended configuration by the expansion of the frame. Rods 72 are inter-engaged by tubes 74 shaping the lower portion of the blind, and the lower edge is secured with tie downs and stakes. The blind is ready for use.

While a preferred embodiment of the invention has been described using specific terms, such description is for illustrative purposes only, and it is to be understood that changes and variations may be made without departing from the spirit or scope of the following claims.

What is claimed is:

1. A portable hunting blind adaptable between a portable position and a hunting position, said blind comprising:

a support frame which includes a support rod elevated above the ground in said hunting position; said support rod mounting a plurality of pivotal fingers at a first end, a pair of intermediate pivotal fingers at an intermediate position, and a pair of pivotal fingers at a second end, said support rod and each of said fingers being moveable between an extended position and a retracted position;

a mounting member connected with said second end, said mounting member being operative to secure with an upstanding member to retain said support frame in a desired elevated position with said support rod extending outwardly from said mounting member elevated above the ground;

a flexible cover shaped to include a top panel, a plurality of front and side panels, and a back panel, all connected along one edge with said top panel, and along opposed edges with an adjacent of said side, front and back panels, to form an enclosure;

a plurality of horizontal sighting slits formed at a first elevation in selected of said panels, said slits functioning to provide sight access through said selected of said panels;

a plurality of larger vertical slits formed in selected of said panels at a second elevation above said horizontal slits, said second slits providing shooting openings through which projectiles may be shot;

wherein said blind may be transported in said portable position to a desirable location, arranged into said hunting position providing concealment for a hunter.

2. The system of claim 1 wherein said cover includes grommets with one of said grommets being located at each said intersection of said top edge with an edge of one of said front, back, and side panels.

3. The system of claim 2 wherein ends of said pivotal fingers are secured with said cover with securing elements connecting said ends of said fingers to said cover whereby said cover is retained in fixed position relative to said support frame.

4. The system of claim 1 wherein said mounting member comprises an elongated mounting bracket having a generally concave inner face for engaging along its length with said upstanding member and elongated guide slots along its outer face, said guide slots acting to receive a mounting slide capable of longitudinal adjustment along said bracket for vertically adjusting the height of said support frame.

5. The system of claim 4 wherein said mounting bracket includes a plurality of transverse slots along its length between said guide slots and a locking member carried by said mounting slide for receiving with said transverse slots for locking said mounting slide in selected vertical positions along said mounting bracket.

6. The system of claim 1 wherein said support rod includes an inner and outer member, said inner member being telescopically carried within said outer member and moveable between an extended position and a transport position and locking means securing said inner member in fixed position when in said transport position and said extended position.

7. The system of claim 1 wherein said support rod carries a mounting clasp at said first end, said intermediate position, and said second end, each said mounting clasp mounting selected one of said fingers at said first end, said intermediate position, and said second end for pivotal movement between said extended and transport positions.

8. The system of claim 1 wherein there are four of said fingers mounted at said first end for supporting said blind front panels to include a first panel extending generally perpendicular of said support rod axis and a pair of second faces extending generally diagonally of said support rod axis thereby providing a panoramic searching and shooting side.

9. The system of claim 1 wherein there is a single finger carried on opposed sides of said support rod at said intermediate position and said second end of said single fingers wherein in said extended position said side and rear panels are substantially planer with said cover.

10. The system of claim 1 wherein selected of said sighting slits in said front and side panels are located at a horizontal position generally level with said hunter's eyes when sitting and second ones of said sighting slits are arranged at a higher horizontal position generally level with said hunter's eyes when standing.

11. A hunting blind for concealing a hunter in a sitting and searching position, and a standing shooting position comprising;

a frame positioned in an elevated position above the ground, said frame having a support rod extending outwardly in an elevated position above the ground said support rod including a front and a back end with a plurality of fingers extending laterally from said front and back ends of said support rod;

a shaped cover having a plurality of holes formed therein at selected positions defining a top panel, a back panel, side panels, and front panels;

said front panels having slits arranged at selective vertical heights defining horizontal and vertical openings providing said hunter with searching and shooting openings;

fasteners securing said finger ends with said cover through said holes to position said top panel in a generally horizontal position and support said front, side, and back panels to extend generally vertically therefrom;

a lower frame extending about lower portions of said front, side and back panels radially positioning said lower portions of said panels into generally vertical alignment with upper portions of said panels whereby;

said hunting blind provides an enclosed area having a sitting search position for a hunter through said horizontal slits and a standing shooting position through said vertical slits.

* * * * *